United States Patent [19]

Lane, Jr.

[11] 4,082,208

[45] Apr. 4, 1978

[54] MODULAR CHEST BACK PACK

[76] Inventor: Gordon Brandon Lane, Jr., 25292 Perch Dr., Dana Point, Calif. 92629

[21] Appl. No.: 718,679

[22] Filed: Aug. 30, 1976

[51] Int. Cl.[2] ..... A45F 3/04

[52] U.S. Cl. ..... 224/8 R; 220/4 D; 224/45 G; 220/410

[58] Field of Search ..... 224/8 R, 9, 45 G, 55, 224/58, 25 A; 220/4 C, 4 D, 9 F; 206/503, 509, 545

[56] References Cited

U.S. PATENT DOCUMENTS

| | | | |
|---|---|---|---|
| 922,046 | 5/1909 | Royce | 224/9 |
| 2,396,346 | 3/1946 | Roody, Jr. | 206/509 X |
| 2,456,481 | 12/1948 | Ballantyne et al. | 206/509 X |
| 3,618,759 | 11/1971 | Kolasinski et al. | 224/55 X |
| 3,623,634 | 11/1971 | Norgard | 206/509 |
| 3,811,559 | 5/1974 | Carter | 220/4 D X |
| 3,851,754 | 12/1974 | Jones | 220/4 D X |
| 3,908,852 | 9/1975 | Ricobene et al. | 220/4 D X |
| 3,980,216 | 9/1976 | Nye | 224/8 R |
| 4,020,986 | 5/1977 | McAtee | 220/9 F X |

*Primary Examiner*—Trygve M. Blix
*Assistant Examiner*—Winston H. Douglas
*Attorney, Agent, or Firm*—William P. Green

[57] ABSTRACT

A back pack assembly including a plurality of hollow container sections to be stacked vertically and contain ice or another cooling or heating substance located within one of the sections, with at least one other section having its interior in communication with the first to have its contents cooled or heated by said substance.

9 Claims, 10 Drawing Figures

MODULAR CHEST BACK PACK

BACKGROUND OF THE INVENTION

This invention relates to improved easily transported chests of unique modular construction for keeping food items or the like in a desired cool or warm condition, usually the former.

The types of portable ice chests which are currently on the market are very inconvenient for transporting food to a picnic site, beach, overnight camp site, or the like. These conventional chests are in most instances cumbersome to handle and carry, and do not usually segregate the ice from the food and supplies satisfactorily. The ice upon melting forms water in the chest, which then tends to dampen and damage the food and supplies, and frequently by the end of the day or trip everything is disorganized and floating in ice water.

SUMMARY OF THE INVENTION

A major purpose of the present invention is to provide an improved chest structure, desirably adapted to be carried as a back pack, which is especially designed to allow segregation of different items from one another, while preferably enabling effective control of the temperature of these items over a period of many hours. Further, the device is very easy to load or unload with food items and supplies, and can be varied in size to accomodate whatever quantity of food and supplies may be desired for a particular trip.

A unit embodying the invention includes a plurality of container sections which can be interconnected in vertically stacked relation, and to which a shoulder strap or straps may be connected to support the combination on the back of a user. The number of these stacked container sections can be varied in accordance with the amount of food and the like to be transported. Ice or another temperature control substance can be positioned in one of the sections, with a second section which is stacked thereon preferably having its interior in communication with the lower first section to have its contents cooled by air from the first section. Similarly, one or more additional hollow sections may be stacked on the first two to be cooled thereby. All of the sections may have their walls formed of heat insulative material, to minimize the conduction of heat between the interior and exterior of the chest structure. All sections of the device above the bottom one may have apertured bottom walls for supporting items therein while allowing free flow of air between the different sections. These bottom walls may be removable, and may be replaced by imperforate bottom wall elements when it is desired to isolate the interior of one of the sections from others of the sections.

For transporting the modular chest assembly from place to place, I provide a strap arrangement which preferably includes a first strap extending essentially horizontally about one of the sections, and a second strap extending essentially vertically about all of the sections to retain them together and retain a cover on the top section. Shoulder straps for supporting the overall structure on the back of a user may be connected at opposite ends to these two straps. One or both of the straps are preferably received partially within a recess or recesses in the surfaces of the containers to locate the straps in fixed positions relative thereto. A carrying handle may be attached to the vertical strap for carrying the assembly by hand when desired.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
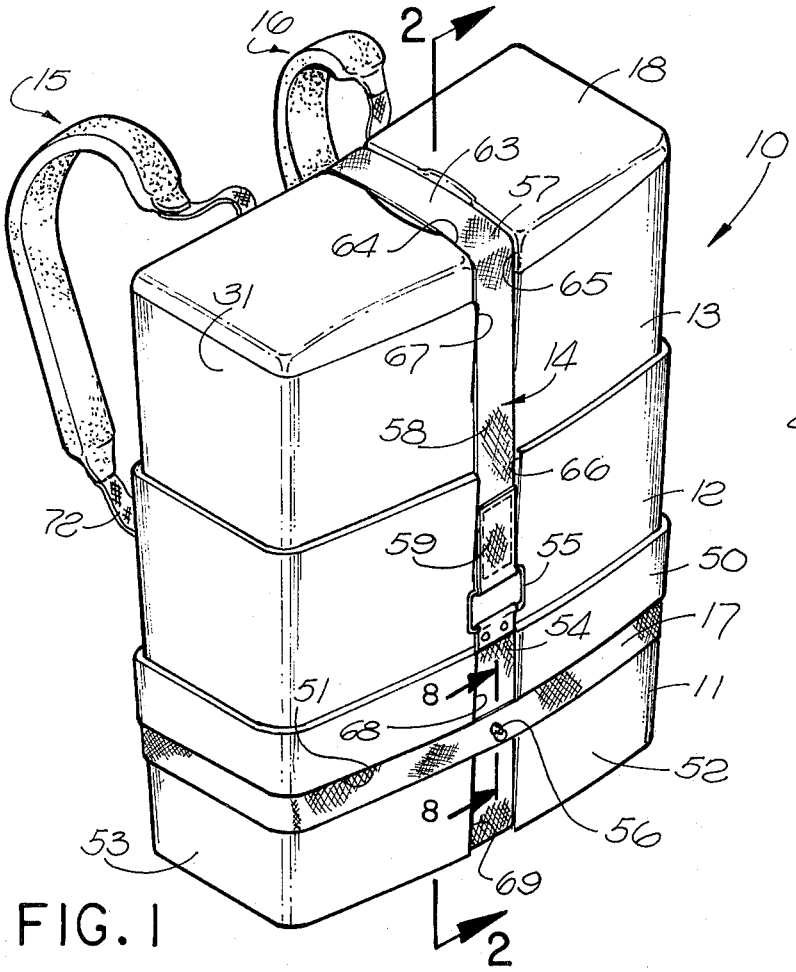
FIG. 1 is a front perspective view of a back pack chest constructed in accordance with the invention, shown in assembled condition.

As seen best in FIG. 1, a modular back pack assembly constructed in accordance with the invention is illustrated generally at 10, and includes a plurality of vertically stacked container or chest sections or modules, three such sections being illustrated at 11, 12 and 13 in FIG. 1. These sections are connected together by a strap 14, and are supported from a pair of shoulder straps 15 and 16 by the strap 14 and a lower strap 17. A cover 18 closes the top of the upper section 13, and will also fit on and close the top of either of the other sections 12 or 11 when fewer sections are to be employed.

Figure 3:
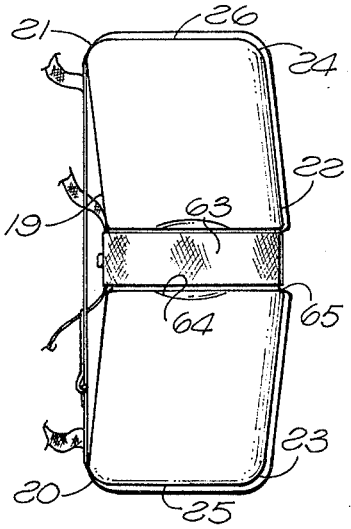
FIG. 3 is a top plan view taken on line 3—3 of FIG. 2.

The horizontal outline configuration of cover 18 is illustrated in FIG. 3, having a rear edge 19 which curves slightly forwardly between its opposite ends 20 and 21, and having a forward edge 22 which is similarly curved forwardly intermediate its opposite extremities 23 and 24. The opposite side edges 25 and 26 of cover 18 may be essentially parallel to one another and extend in a front to rear direction.

Figure 5:
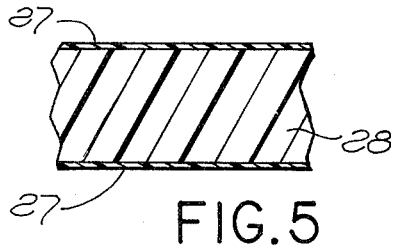
FIG. 5 is an enlarged section on line 5—5 of FIG. 2.

This cover 18 and the three sections 11, 12 and 13 are all formed of a heat insulative material for minimizing the conduction of heat from the exterior of the assembly to its interior. For example, as shown in FIG. 5, the cover and sections 11, 12 and 13 may all be formed of a thin fluid impervious shell of resinous plastic material 27 filled with a resinous plastic foam substance 28 such as styrofoam or polyurethane foam having the desired insulative characteristics.

Figure 2:
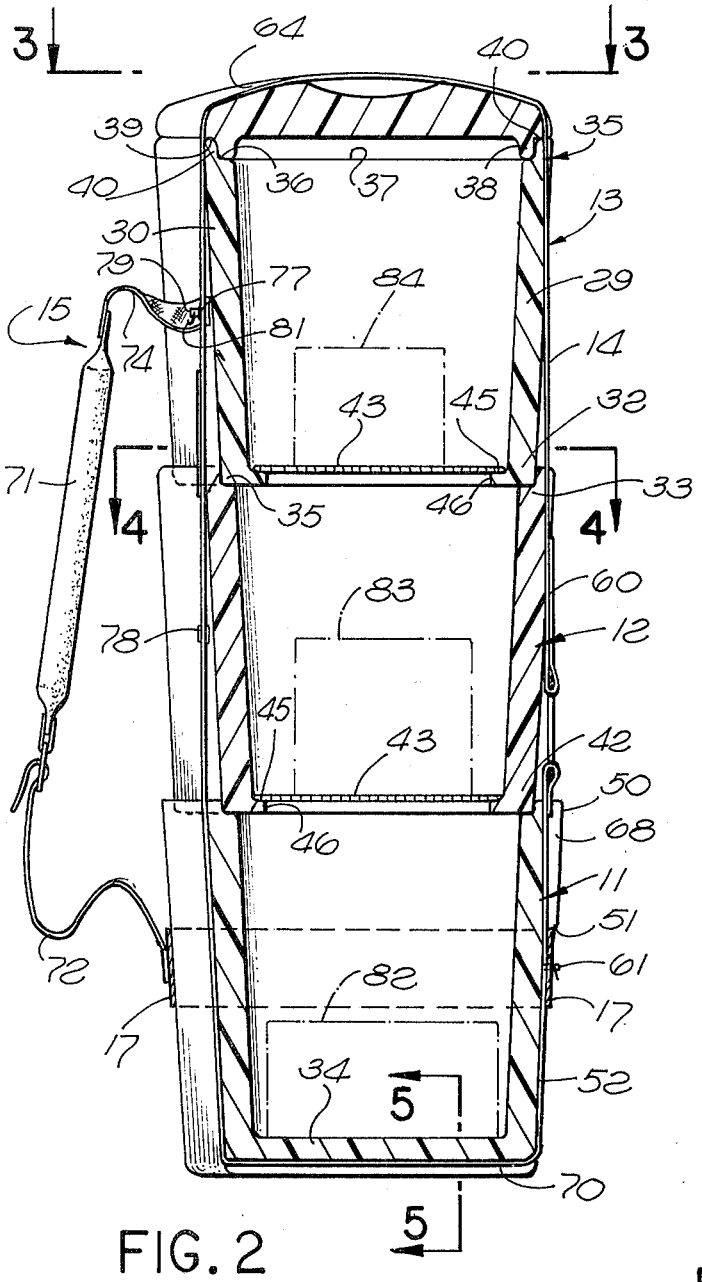
FIG. 2 is a vertical section taken on line 2—2 of FIG. 1.
Figure 4:
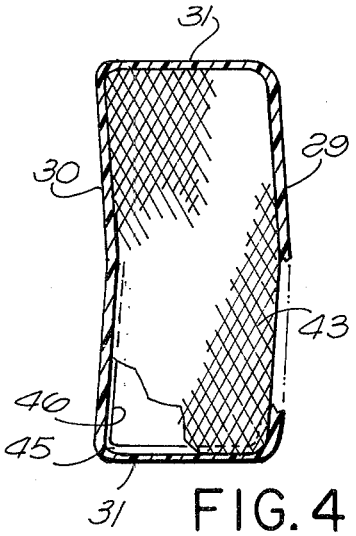
FIG. 4 is a horizontal section taken on line 4—4 of FIG. 2.

The three sections 11, 12 and 13 have a horizontal sectional configuration which is the same as that of cover 18 as seen in FIG. 3, except that as the front wall 29 (FIG. 2), and rear wall 30, and opposite side walls 31 of each of these sections advance downwardly they taper inwardly to a slightly reduced size enabling the lower portion 32 of upper section 13 to next into and be supported by the upper portion 33 of section 12, and similarly enabling the lower portion of section 12 to nest into the upper portion of bottom section 11. A horizontal wall 34 closes the bottom of section 11 as seen in FIG. 2.

For removably receiving cover 18 in air tight sealed relation, the upper edge 35 of top section 13 contains a shallow recess 36 forming a horizontal upwardly facing ledge 37 which engages a downwardly projecting rib 38 of cover 18 continuously along the entire periphery of the upper edge of section 13 to form an airtight seal therewith. Above and outwardly of the rib 38, the cover has a downwardly facing horizontal flange surface 39, engageable with an upper horizontal surface 40 formed on an upwardly projecting peripheral portion 41 of section 13 to further enhance the airtight seal between the cover and that section.

The upper edge portion 33 of intermediate section 12 of the modular assembly is shaped the same as the upper edge of section 13, and in particular has a recess such as that described at 36, to present upwardly facing support surfaces as shown at 37 and 40, with an upwardly projecting peripheral portion such as that shown at 41. Consequently, the cover 18 will fit on the top of section 12 when section 13 is removed, and will form the same type of seal with section 12 as with section 13. Similarly, the upper edge of bottom section 11 is shaped the same as the upper edges of the other two sections, to receive and support cover 18 when only one section is to be employed.

The lower reduced dimension portion 32 of top section 13 is shaped to be exactly received within and nest into the recess 36 at the top of section 12, and thereby peripherally engage surface 37 of section 12 and be confined within its upwardly projecting portion 41 in an effectively supported and airtight relation. In the same manner, the lower reduced dimension portion 42 of section 12 projects into the recess 36 at the top of section 11, and nests therein in an airtight and supported relation.

Figure 4A:
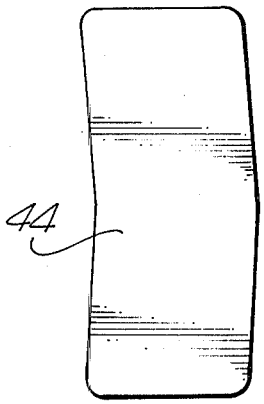
FIG. 4*a* shows one of the imperforate bottom walls which may be utilized in the two upper sections of the device.

The interiors of the three sections 11, 12 and 13 in their FIG. 2 stacked condition are preferably in communication with one another under most conditions of use. For this purpose, the two upper sections 12 and 13 may have horizontal bottom walls 43 which are apertured to permit flow of air vertically therethrough, and which desirably are removable from the sections for replacement by imperforate bottom walls 44 (FIG. 4*a*) when conditions arise under which it may be desirable to prevent communication between the different sections. Imperforate walls 44 are preferably of greater thickness than walls 43 and heat insulative in character, typically consisting of a resinous plastic foam encased within a plastic skin as in FIG. 5. To support these walls 43 and 44, each of the sections 12 and 13 has an upwardly facing shoulder 45 formed at the inner sides of the lower extremities of the front, rear and side walls 29, 30 and 31, to engage the edge of bottom wall 43 or bottom wall 44 continuously along its periphery in a manner supporting the wall in horizontal condition. The perforated walls 43 may take the form of a relatively open mesh formed of a resinous plastic material. Both the perforated walls 43 and the imperforate walls 44 of course have sufficient stiffness and strength to support food items or other contents to be placed in the corresponding container section 12 or 13. Inwardly of the support shoulder 45, the bottom of each of the sections 12 and 13 contains and defines a large opening 46 extending across almost the entire horizontal extent of the lower portion of the section to provide open communication between the successive sections except as that communication is partially obstructed by apertured bottom wall 43 or completely obstructed by one of the imperforate bottom walls 44.

Figure 9:
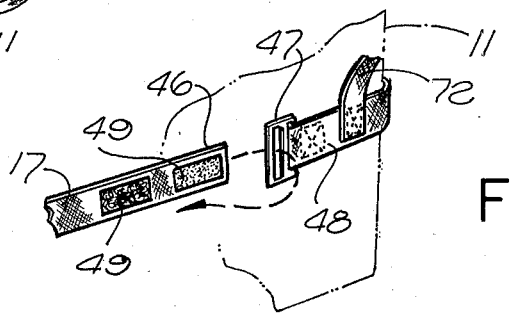
FIG. 9 is a fragmentary perspective view of the lower strap showing its ends detached.

The strap 17 extends essentially horizontally about bottom section 11 of the chest assembly, and is detachably secured in position on section 11 in appropriate manner, as by passing one end 46 of strap 17 (FIG. 9) through a buckle or loop element 47 carried by the other end 48 of strap 17, and then doubling the end 46 back on itself and securing it in such doubled condition by appropriate fasteners such as 'velcro' fasteners 49. For assisting in transmitting upward lifting or supporting force from strap 17 to bottom section 11 of the chest assembly, section 11 may be molded to have an upper increased thickness portion 50 presenting a downwardly facing shoulder 51 beneath which strap 17 is received to engage upwardly against that shoulder across front wall 52 of section 11, and also along the front to rear length of side walls 53 of section 11.

Figure 8:
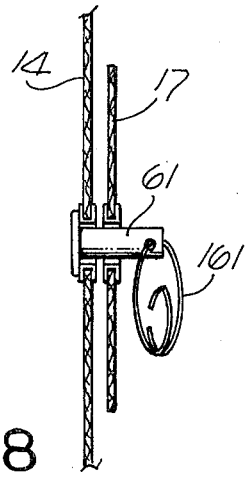
FIG. 8 is an enlarged section taken on line 8—8 of of FIG. 1.

The strap 14 extends essentially vertically about all three of the sections 11, 12 and 13, and cover 18 to retain them in assembled condition. One end portion 54 (FIG. 1) of strap 14 may carry a buckle loop 55, and be detachably connected at 56 to a front portion of strap 17, and then extend horizontally beneath section 11 and upwardly at the back of all three of the sections 11, 12 and 13, to ultimately extend forwardly across the top of the central portion of the cover at 57, and then downwardly at 58 for detachable connection to loop 55. This connection may be made by passing the extremity of portion 58 of strap 14 through the loop, and then doubling it upwardly at 59 for connection to itself, by interlocking velcro fastener pads 60. The connection at 56 between straps 14 and 17 (FIG. 8) may be effected by providing the two straps at that location with metal grommets through which a headed pin 61 extends, with a coiled wire or other retaining element 161 passing through a transverse opening in the shank of pin 61 to releasably retain it against removal from the grommets, or alternatively snap fasteners or the like may interconnect the straps.

The portion 57 of strap 14 which extends across the top of cover 18 functions as a handle by which the entire assembly may be carried by one hand of a user when desired rather than in back mounted condition. A central recess 164 in the top of cover 18 allows a user to slip his fingers beneath the strap to carry the assembly. In front of and behind recess 164, the cover contains aligned grooves 64, of a width to closely receive and locate the strap, with the forward one of these grooves having a forward portion 65 extending downwardly at the front of the cover. Similarly, the sections 12 and 13 contain vertical grooves 66 and 67 in the upper portions of their front walls, dimensioned to closely receive and locate strap 14 as it extends downwardly therein. The upper thickened portion 50 of lower section 11 contains a similar vertical groove 68, which is aligned with a groove 69 formed in the lower portion of the front wall of section 11. This lower groove 69 merges with a groove 70 extending horizontally across the central portion of the underside of bottom wall 34 of section 11. Thus, strap 14 is very effectively held in its illustrated central position relative to the three sections 11, 12 and 13 and cover 18.

The shoulder straps 15 and 16 may be identical, each having a padded portion 71 connected at one end by an adjustable strap 72 to the lower horizontal encircling strap 17. The other end of each shoulder strap has a portion 74 containing two metal grommets 75 and 76 either of which may be connected to either one of two metal grommets 77 and 78 carried by strap 14 at vertically spaced locations. This connection may be made by a headed pin 79 of the same type as the previously discussed pin 61 coacting with a spiral wire 81 or other retaining element which extends through a transverse opening in pin 79 to retain the pin against removal from the two connected grommets.

Figure 6:
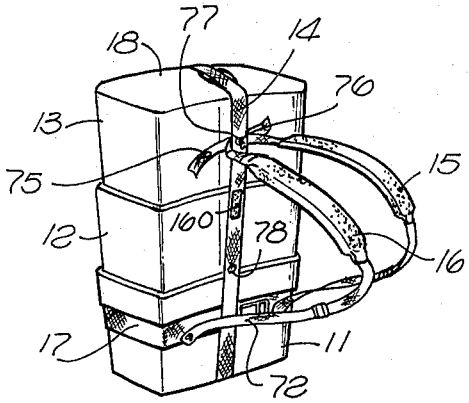
FIG. 6 is a rear perspective view of the assembly.

To now describe the manner of use of the assembly, assume that the two straps 74 are connected to strap 14 in the manner illustrated in FIG. 6, with the two end grommets 75 of straps 74 connected to the upper grommet 77 of strap 14. The three containers 11, 12 and 13 are first filled with the food and supplies which are to be transported in the device, with the three sections being completely separated from one another during such filling so that each may be filled easily and quickly through its top opening. The bottom section 11 preferably contains a block or quantity of ice, or a frozen block or unit of artificial 'ice', as represented at 82 in FIG. 2. More particularly, this artifical 'ice' may consist of a plastic bag or container having a quantity of liquid confined therein which is adapted to be frozen or reduced to a very low temperature in a refrigerator, and will then serve the purpose of ice in the present chest. The various food or supply items are placed in the other two compartments 12 and 13 as represented at 83 and 84, and the three compartments are then stacked in superimposed relation, with cover 18 being placed on the top of the stack, and with the three modules and cover then being retained tightly together by strap 14 as illustrated in FIG. 1. After the assembly has been completed in this manner, a user supports it on his back by passing his arms through shoulder straps 15 and 16, and thereby supporting the weight of the entire assembly from his shoulders. During transportation, the open communication between the interiors of the three sections 11, 12 and 13, through mesh bottom walls 43 of the two top sections, enables the real or artificial ice 82 to effectively cool the interior of all of these sections and all of the food in the upper sections away from contact with the ice and any water produced by melting the ice in bottom section 11. The continuous peripheral connections between the various superimposed sections and cover 18 prevent communication of the interior of the assembly with its exterior. The picnic items are thus kept in well organized condition without water damage for a relatively long period of time, and by virtue of the back pack arrangement are transported to any desired location in the easiest possible manner.

If the contents of the assembly are to be kept warm instead of cool, an appropriate warming unit may be substituted for the ice 82, or if desired one or more of the imperforate walls 44 may be employed to enable maintenance of some of the items in cool condition while others are warm.

Figure 7:
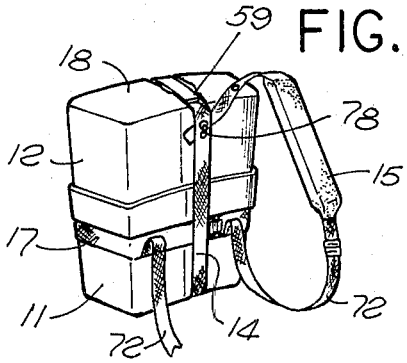
FIG. 7 is a view similar to FIG. 6, but showing the device when only two of the sections are in use.

If more supplies are to be taken than can be held in the three units, one or more added sections such as 12 and 13 can be added onto the top of the assembly, and an appropriately lengthened strap 14 can be utilized. Also, if less than three sections are desired on a particular trip, one or more of the upper sections can be removed, as for instance as illustrated in FIG. 7 in which only two sections 11 and 12 are employed, with the cover 18 being placed on section 12. In this instance, the extremities 74 of the shoulder straps may be connected to the lower grommet 78 of strap 14, to appropriately adjust the shoulder straps for a shorter height chest assembly. Selection between the grommets 75 or 76 affords another adjustment of the shoulder straps, to enable them to fit any person. Also, in the FIG. 7 condition, the velcro fastener 60 on the extremity 59 of strap 14 is secured to an additional velcro fastener 160 carried by an upper portion of strap 14 to appropriately tighten the strap in shortened condition about the two sections.

While a certain specific embodiment of the present invention has been disclosed as typical, the invention is of course not limited to this particular form, but rather is applicable broadly to all such variations as fall within the scope of the appended claims.

I claim:

1. A back pack comprising:

a plurality of hollow vertically stacked containers which have openings at their upper sides and are separable from one another to allow access to the interior of the containers individually through said openings for placing items therein and removing them therefrom;

said containers being shaped similarly, with vertically successive containers peripherally engaging one another in nesting interfitting relation;

said containers having walls formed of heat insulative material to minimize heat transfer between the interior and exterior thereof;

a cover of heat insulative material for peripherally engaging and closing a top container of the stack and adapted to be opened to permit access to the interior thereof;

a first strap extending vertically about said stack of containers and said cover to secure them together and exert upward supporting force on the stack, and releasable to permit separation of the containers;

a second strap extending horizontally about the bottom container of said stack;

means on said bottom container engaging said horizontally extending strap in a relation to exert upward supporting force on the bottom container and through it the stack from said horizontally extending strap;

two shoulder straps for carrying the stack as a back pack;

means attaching upper ends of said two shoulder straps to said vertically extending strap at a location spaced above said horizontally extending strap; and means attaching lower ends of said shoulder straps to said horizontally extending strap at opposite sides respectively of said vertically extending strap.

2. A back pack as recited in claim 1, including means for attaching said vertically extending and horizontally extending straps together at an intersection thereof.

3. A back pack as recited in claim 1, in which said means on the bottom container engaging said horizontally extending strap include a downwardly facing shoulder formed on said bottom container and extending along different sides thereof and against which said horizontally extending strap is engageable upwardly in supporting relation.

4. A back pack as recited in claim 1, in which said containers and said cover have recesses within which said vertically extending strap is received to locate the containers relative to said vertically extending strap.

5. A back pack as recited in claim 1, in which one of said containers above the bottom container has a bottom wall structure on which items in that container may be supported but which is open to flow of air between the interior of said one container and a container therebeneath to enable cooling or heating of both containers by ice or another cooling or heating substance in only one of the containers.

6. A back pack as recited in claim 1, in which one of said containers above the bottom container has an apertured bottom wall removable therefrom and adapted to support items therein but open to flow of air between said one container and a container therebeneath.

7. A back pack as recited in claim 1, including two bottom walls selectively positionable in the bottom of one of said containers above said bottom container, one of said walls being imperforate, and the other of said walls being apertured to permit flow of air vertically between said one container and a container therebeneath.

8. A back pack comprising:

a series of hollow vertically stacked containers which have openings at their upper sides and are separable from one another to allow access to the interior of the containers individually through said openings for placing items therein and removing them therefrom;

said containers being shaped similarly, with each of the containers except the top one thereof in the stack having an upper portion peripherally engaging a lower portion of the next container thereabove in nesting interfitting supporting relation;

said containers having walls formed of heat insulative material to minimize heat transfer between the interior and exterior thereof;

each of said containers except a bottom one thereof having a bottom wall structure on which items may be supported but which is open to flow of air between the interiors of two successive containers to enable cooling or heating of items in all of the containers by ice or another cooling or heating substance located in only one of the containers;

a cover of heat insulative material for peripherally engaging and closing said top container of the stack and adapted to be opened to provide access to the interior thereof;

said cover being adapted to peripherally engage and close any of the containers in the stack beneath said top container upon removal of the container or containers thereabove from the stack;

a first strap extending vertically about said stack of containers and said cover and received and located within recesses in the containers and cover, and acting to secure the series of containers together and exert upward supporting force on the bottom container, with the strap being releasable to permit separation of the containers;

a second strap extending horizontally about said bottom container;

said bottom container having a downwardly facing shoulder above said horizontally extending strap and against which said horizontally extending strap is engageable upwardly in a relation to exert upward supporting force on the bottom container and through it the stack from said horizontally extending strap;

two shoulder straps for carrying the stack as a back pack;

means attaching upper ends of said two shoulder straps to said vertically extending strap at a location spaced above said horizontally extending strap; and means attaching lower ends of said shoulder straps to said horizontally extending strap at opposite sides respectively of said vertically extending strap.

9. A back pack as recited in claim 8, including fastener means detachably securing said vertically extending strap to said horizontally extending strap at an intersection thereof; said means attaching upper ends of said two shoulder straps to said vertically extending strap including detachable connector means operable to detachably secure said upper ends of said shoulder straps to said vertically extending strap at a plurality of different vertically spaced locations; said vertically extending strap including fastener means for detachably securing opposite ends of said vertically extending strap together with the vertically extending strap at different effective lengths to encircle and tightly retain different numbers of said containers in a stack.

* * * * *